US007192331B1

(12) United States Patent
Ward

(10) Patent No.: US 7,192,331 B1
(45) Date of Patent: Mar. 20, 2007

(54) FIGURE KICKING TOY

(76) Inventor: James Ward, 3610 Bevis Ave., Cincinnati, OH (US) 45207

( * ) Notice: Subject to any disclaimer, the term of this patent is extended or adjusted under 35 U.S.C. 154(b) by 41 days.

(21) Appl. No.: 11/032,654

(22) Filed: Jan. 11, 2005

(51) Int. Cl.
*A63H 13/02* (2006.01)
*A63H 13/00* (2006.01)

(52) U.S. Cl. ..... 446/333; 472/51

(58) Field of Classification Search ..... 446/333–336; 472/51, 54, 55, 137
See application file for complete search history.

(56) References Cited

U.S. PATENT DOCUMENTS 1,268,029 A 5/1918 Lyon
1,322,199 A 11/1919 Murphy
1,632,439 A * 6/1927 Foans ..... 446/333
1,633,456 A * 6/1927 Norberg ..... 446/333
3,911,616 A * 10/1975 Pelfrey ..... 446/333
4,457,100 A 7/1984 Nightingale
6,293,874 B1 * 9/2001 Armstrong ..... 472/51

* cited by examiner

*Primary Examiner*—Kien Nguyen
(74) *Attorney, Agent, or Firm*—Crossley Patent Law; Mark A. Crossley

(57) ABSTRACT

A figure kicking toy with a crank activated kicking leg with boot of the first figure pivoting to contact the posterior of the second figure. The kicking leg has a return spring for restoring the leg to upright position. The preferred embodiment offers rubberized material, at least in the second figure, to allow air compression from the boot contact to dislodge the head of the second figure. The preferred embodiment has a two headed second figure with heads representing Osama bin Laden and Saddam Hussein respectively.

11 Claims, 2 Drawing Sheets

FIGURE KICKING TOY

BACKGROUND OF THE INVENTION

1. Field of the Invention

This invention relates to toys and more especially to a figure kicking toy with two figures, one of which delivers a kick to another.

2. Description of the Prior Art

While several mechanically activated toy figures are taught by the prior art, none are of the precise design of the present invention. By way of example:

U.S. Pat. No. 1,322,199 issued to Murphy on Nov. 18, 1919 discloses a device with wheels that pivotally engage one leg of one figure to kick another figure, the other figure having a leg pivotally engaged with the wheel mechanism to also allow that leg to pivot. The toy is more complex than the current invention and does not share the same design and operational mechanics.

U.S. Pat. No. 1,268,029 issued to Lyon on May 28, 1918 discloses a fairly complex device in which a horse or the like is kicking another, human figure that pivots. The device is fairly complex and differs significantly from the present invention in both design and function.

U.S. Pat. No. 4,457,100 issued to Nightingale on Jul. 3, 1984 discloses a device which articulatingly links a kicking foot to a human figure receiving a kick. The figure receiving the kick has several additional articulating movements. The battery powered device is not only substantially different from but also much more complex than the basic design of the present invention.

While the above-described devices fulfill their respective and particular objects and requirements, they do not describe a figure kicking toy that provides for the advantages of the present invention, therefore, a need exists for an improved figure kicking toy. In this respect, the present invention substantially departs from the conventional concepts and designs of the prior art.

SUMMARY OF THE INVENTION

In view of the foregoing disadvantages inherent in the known types of figure toys now present in the prior art, the figure kicking toy overcomes the above-mentioned disadvantages and drawbacks of the prior art. As such, the general purpose of the figure kicking toy, described subsequently in greater detail, is to provide a figure kicking toy which has all of the advantages of the prior art mentioned heretofore and many novel features that result in an improved figure kicking toy which is not anticipated, rendered obvious, suggested, or even implied by the prior art, either alone or in combination thereof.

To accomplish this, the figure kicking toy is comprised of a base upon which are mounted two human figures. The first figure is upright and has a pivoting leg which swings toward and contacts the posterior of the second figure. The pivoting leg is operated by a crank. The crank is comprised of a crank shaft that passes through both hips of the legs of the first figure. The crank shaft is anchored within the kicking leg and rotates freely within the standing leg of the first figure. Further, the crank has a coil spring trapped within the kicking leg such that the spring's force returns the kicking leg to an upright vertical position coplanar with the standing leg, when the crank handle is released. A perpendicular joins the crank shaft and the crank handle to provide leverage. The second figure, in the preferred embodiment, is double headed, with the heads depicting Osama bin Laden and Saddam Hussein. The second figure is slightly bent over.

While the preferred embodiment portrays the first figure as Uncle Sam and the second a double headed figure of terrorists, other embodiments offer single heads and portrayals of various prominent individuals and symbolisms thereof. The figures are not constrained to merely those shown in the preferred embodiment.

Additionally, the preferred embodiment utilizes plastics and rubberized plastics for the figures, and even the base. By virtue of the rubberized plastic, especially in the second figure, the design of the head release mechanism is enabled, so that the head of the second figure can be ejected with vigorous action of the kicking leg and boot of the first figure. The second figure's internal air space is reduced with vigorous contact of the first figure's kicking boot, thereby ejecting the head of the second figure through air pressure and its subsequent release upon head ejection. A neck lip of the second figure, along with the head lip of the head, prevent inadvertent loss of the second figure's head until pressure is applied. Reinstallation of the head is a simple push fit. Further embodiments do not utilize the head ejecting feature and are therefore composed of various materials, including but not limited to wood, hard plastic, or even metal.

Preferably, the toy is about 12 inches long, 12 inches high and 5 inches wide. A variety of colors are employed to enhance appearances of the figures. The toy is sold to provide comic relief from terrorists' and other unpleasant or disreputable people. The toy is also sold as a comic tool in political or celebrity use.

Thus has been broadly outlined the more important features of the figure kicking toy so that the detailed description thereof that follows may be better understood and in order that the present contribution to the art may be better appreciated.

Numerous objects, features and advantages of the figure kicking toy will be readily apparent to those of ordinary skill in the art upon reading the following detailed description of presently preferred, but nonetheless illustrative, embodiments of the figure kicking toy when taken in conjunction with the accompanying drawings. In this respect, before explaining the current embodiments of the figure kicking toy in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the figure kicking toy. It is therefore important that the claims be regarded as including such equivalent constructions insofar as they do not depart from the spirit and scope of the present invention.

Objects of the figure kicking toy, along with various novel features that characterize the invention are particularly pointed out in the claims forming a part of this disclosure. For better understanding of the figure kicking toy, its operating advantages and specific objects attained by its uses, refer to the accompanying drawings and description.

DETAILED DESCRIPTION OF THE PREFERRED EMBODIMENT

With reference now to the drawings, and in particular FIGS. 1 through 4 thereof, the preferred embodiment of the figure kicking toy employing the principles and concepts of the present invention and generally designated by the reference number 10 will be described.

Figure 1:
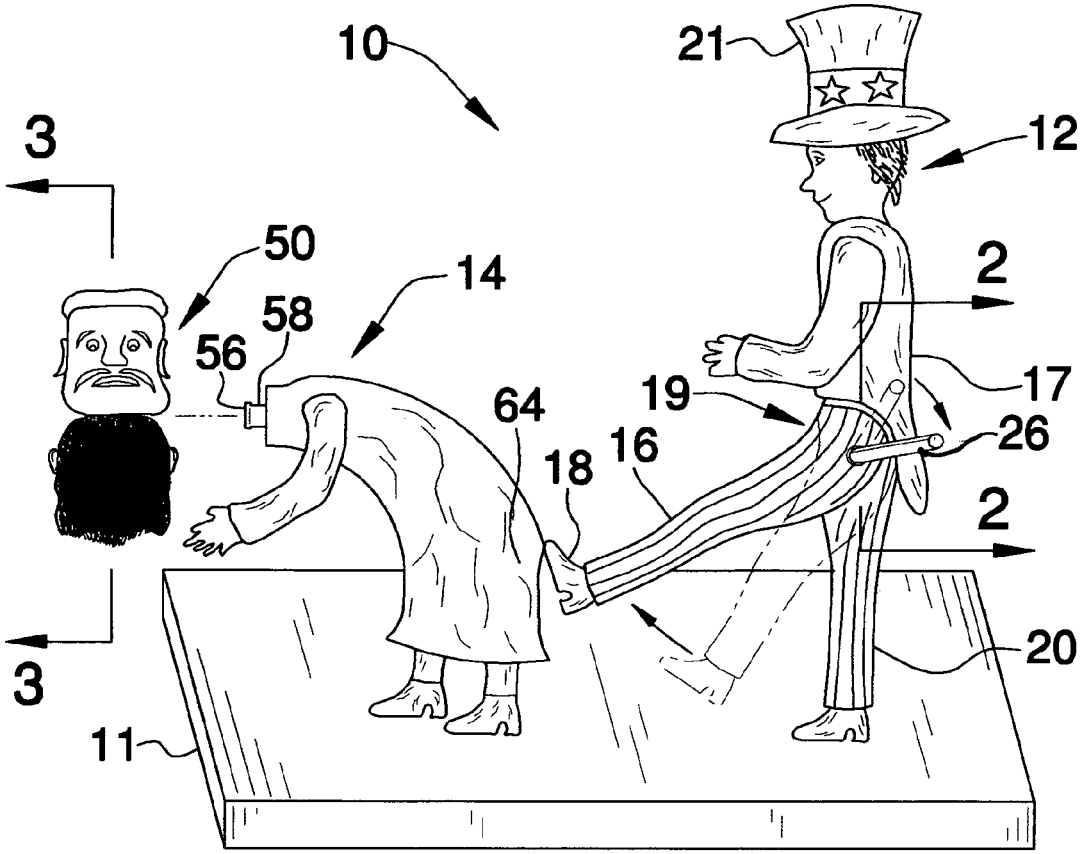
FIG. 1 is a perspective view of the action of figure kicking toy, with head of second figure ejected.
Figure 2:
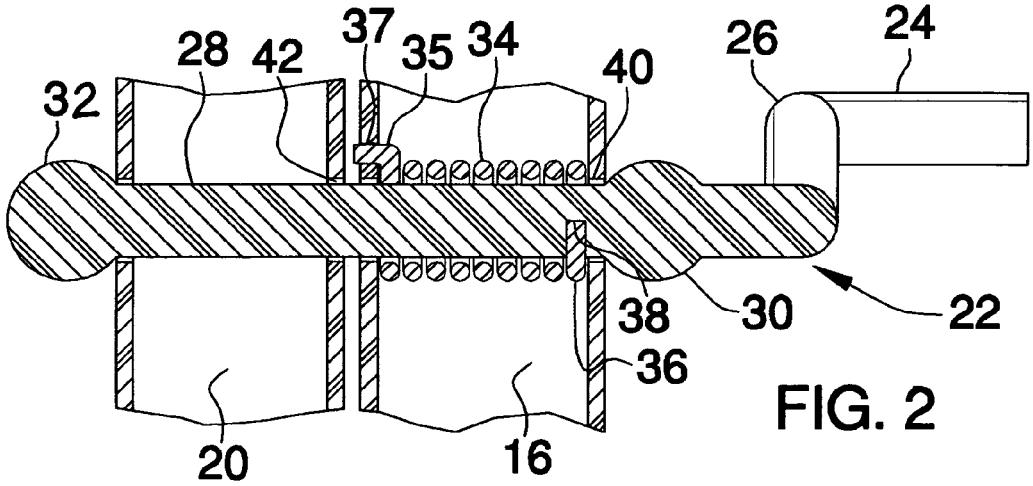
FIG. 2 is a cross sectional view of the leg pivoting and return mechanisms of the first figure.

Referring to FIG. 1, the invention 10 is comprised of a base 11 atop which are mounted a first FIG. 12 and a second FIG. 14. The first FIG. 12 is a depiction of Uncle Sam with typical Uncle Sam clothing such as top hat 21, waist coat 17 with tails, striped pants 19, and boots 18. Second FIG. 2, disposed in front of Uncle Sam is bent in posture, with both feet affixed to the base 11. Atop the shoulders of second FIG. 2 is a neck 58 terminating in neck lip 56. Lip 56 is a slight expansion of neck 58. Just off of neck 58 and lip 56 is double head 50, which has been ejected from second FIG. 14. Both first FIG. 12 and second FIG. 14 are of flexible plastic. Second FIG. 14 is rubberized to be flexible and airtight, with the exception of neck 58, which is open. Contact of kicking boot 18 upon posterior 64 of second FIG. 14 causes a slight compression of air within second FIG. 14, thereby pressurizing double head 50 to eject from neck 58 and lip 56.

Figure 3:
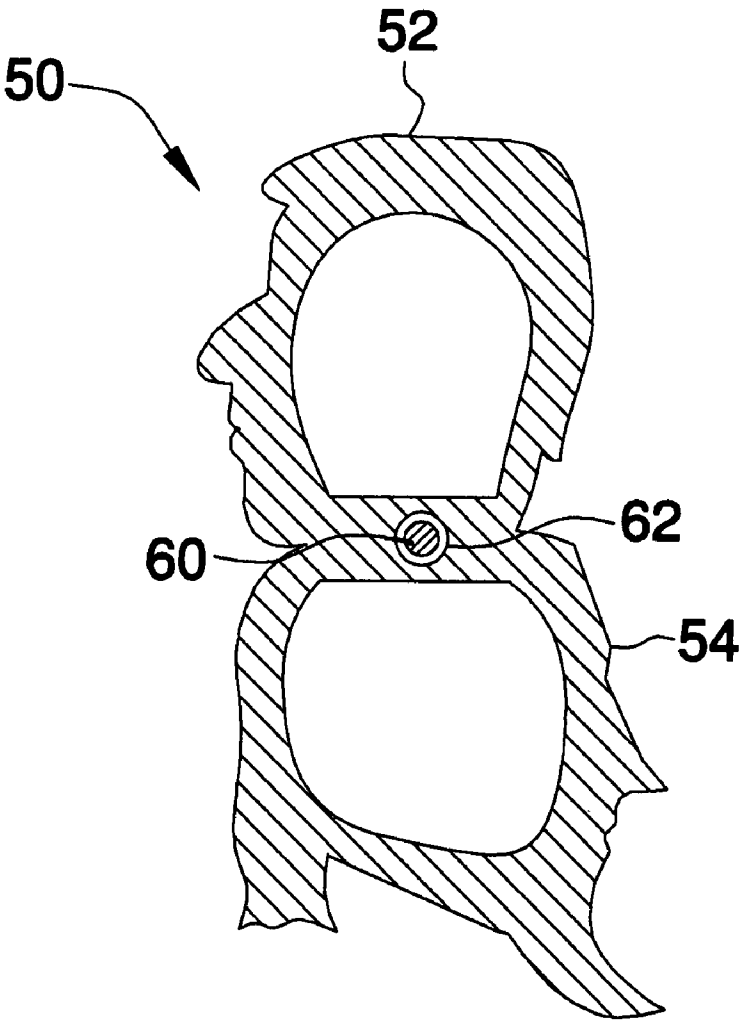
FIG. 3 is a cross sectional view of the double heads joined and the neck receptacle and neck lip thereof.

Referring to FIG. 3, double head 50 is further comprised of neck receptacle 60 at a juncture of upper head 52 and lower head 54. Neck receptacle 60 is further comprised of head lip 62. Head lip 62 interacts with neck lip 56 (FIG. 1) to prevent inadvertent loss of head 50 from neck 58 until intended.

Figure 4:
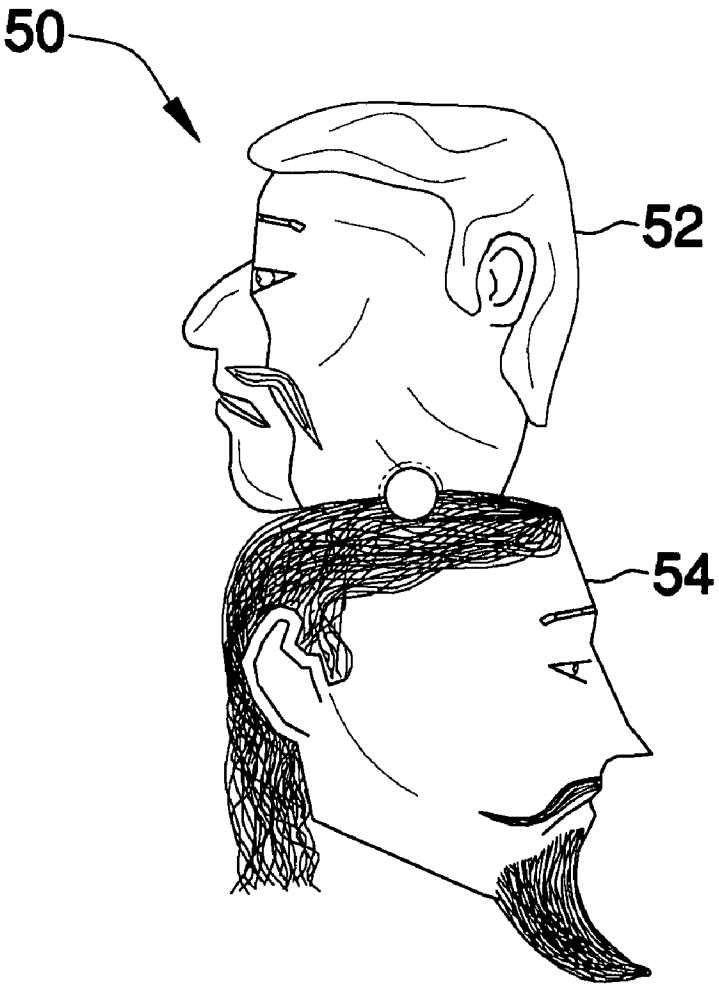
FIG. 4 is a lateral view of the double head of the second figure of the invention.

Referring to FIG. 4, upper head 52 is a likeness of Saddam Hussein, and lower head 54 is a likeness of Osama bin Laden.

Referring to FIG. 2, first FIG. 12 is further comprised of a crank shaft 28 passing horizontally through both hips of kicking leg 16 and standing leg 20. A terminating node 32 secures one end of crank shaft 28 at the lateral boundary of standing leg 20. Shaft 28 rotates freely within standing leg orifices 42 of leg 20. From thence, crank shaft 28 passes through leg kicking leg orifices 40 of leg 16 and is anchored to leg 16. In the medial side of leg 16, insert notch 37 receives spring insert 35 of return spring 34. Spring 34 therefrom encircles shaft 28 and terminates in spring anchor 36. Anchor 36 inserts into anchor notch 38 to therein contain spring 34. Return spring 34 is wound such that kicking leg 16 is vertically aligned with standing leg 20 until influenced by a user (not shown). Just without leg 16, crank shaft 28 enlarges to form node 30 thereby containing shaft 28 within both legs 16 and 20. Just thereafter, shaft 28 bends at a right angle to join crank perpendicular 26. Shortly thereafter, crank perpendicular 26 joins crank handle 24 at a right angle. Crank shaft 28 and crank handle 24 are coplanar.

In actuation, a user holds crank handle 24 of crank 22 and turns handle 24 in a clockwise motion. Overcoming the resistance of return spring 34, kicking leg 16 is thereby pivoted to extend such that boot 18 contacts the posterior 64 of second FIG. 14. If handle 24 is turned vigorously, second FIG. 14 compresses air within second FIG. 14 and causes the ejection of double head 50 from neck 58 and neck lip 56 of second FIG. 14.

Release of crank handle 24 allows return spring 34 to return kicking leg 16 back to vertical position. Double head 50 is easily reinserted upon neck 58.

With respect to the above description then, it is to be realized that the optimum dimensional relationships for the parts of the figure kicking toy, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A figure kicking toy, the toy comprising:

a base with two human figures attached on a top of the base, the first figure having a standing leg and a kicking leg, each with a boot, the standing leg attached to the base and the kicking leg and boot pivotally swinging toward and contacting a posterior of the second figure with the boot, the second figure having a slightly bent posture and with two legs attaching to the base;

a crank, the crank having a crank shaft disposed through the hips of each leg of the first figure, the crank further comprising a crank perpendicular attached to an end of the crank exiting the kicking leg of the first figure, the crank perpendicular terminating in a right angle attachment of a crank handle, the crank handle coplanar with the crank shaft, the crank shaft further secured within the kicking leg and rotating within the standing leg, whereby turning the crank handle pivots the kicking leg to contact the posterior of the second figure, the crank shaft further comprised of an anchor notch laterally disposed within the kicking leg, the notch receiving a spring anchor of one end of a coil spring, the coil spring disposed within the kicking leg and coiled about the crank shaft therewithin, the kicking leg further comprising, in a medial region, an insert notch receiving a spring insert of an opposite end of the coil spring, whereby the tension of the coil spring returns the kicking leg to a vertical rest position.

2. The figure kicking toy in claim 1 wherein the second figure is comprised of a flexible material and a removable head, the figure further comprised of a neck with a neck lip, the head further comprised of a neck receptacle with a neck lip, whereby pressure from the contacting foot of the first figure compresses air within the second figure, thereby causing the head to pop off of the second figure.

3. The figure kicking toy in claim 2 wherein the second figure is further comprised of two heads.

4. The figure kicking toy in claim 3 wherein the toy is about 12 inches long, 12 inches high and 5 inches wide.

5. A figure kicking toy, the toy comprising:

a base with two human figures attached on a top of the base, the first figure having a standing leg and a kicking leg, each with a boot, the standing leg attached to the base and the kicking leg and boot pivotally swinging toward and contacting a posterior of the second figure with the boot, the second figure having a slightly bent posture and with two legs attaching to the base, the second figure comprised of a flexible material and a removable head, the second figure further comprised of a neck with a neck lip, the head further comprised of a neck receptacle with a neck lip;

a crank, the crank having a crank shaft disposed through the hips of each leg of the first figure, the crank further comprising a crank perpendicular attached to an end of the crank exiting the kicking leg of the first figure, the crank perpendicular terminating in a right angle attachment of a crank handle, the crank handle coplanar with the crank shaft, the crank shaft further secured within the kicking leg and rotating within the standing leg, whereby turning the crank handle pivots the kicking leg to contact the posterior of the second figure, the crank shaft further comprised of an anchor notch laterally disposed within the kicking leg, the notch receiving a spring anchor of one end of a coil spring, the coil spring disposed within the kicking leg and coiled about the crank shaft therewithin, the kicking leg further comprising, in a medial region, an insert notch receiving a spring insert of an opposite end of the coil spring, whereby the tension of the coil spring returns the kicking leg to a vertical rest position.

6. The figure kicking toy in claim 5 wherein the toy is about 12 inches long, 12 inches high, and 5 inches wide.

7. The figure kicking toy in claim 6 wherein the second figure is further comprised of two heads.

8. A figure kicking toy, the toy comprising:

a base with two human figures attached on a top of the base, the first figure having a standing leg and a kicking leg, each with a boot, the standing leg attached to the base and the kicking leg and boot pivotally swinging toward and contacting a posterior of the second figure with the boot, the second figure having two legs attaching to the base, the pivotal swinging leg further comprising:

a crank, the crank having a crank shaft disposed through the hips of each leg of the first figure, the crank further comprising a crank perpendicular attached to an end of the crank exiting the kicking leg of the first figure, the rank perpendicular terminating in a right angle attachment of a crank handle, the crank handle coplanar with the crank shaft, the crank shaft further secured within the kicking leg and rotating within the standing leg, whereby turning the crank handle pivots the kicking leg to contact the posterior of the second figure, the crank shaft further comprised of:

an anchor notch laterally disposed within the kicking leg, the notch receiving a spring anchor of one end of a coil spring, the coil spring disposed within the kicking leg and coiled about the crank shaft therewithin, the kicking leg further comprising:

a medial region;

an insert notch receiving a spring insert of an opposite end of the coil spring, whereby the tension of the coil spring returns the kicking leg to a vertical rest position.

9. The figure kicking toy of claim 8 wherein the second figure is further comprised of two heads.

10. The figure kicking toy of claim 9 wherein the base is about 12 inches long by 5 inches wide and the figures are about 12 inches tall.

11. The figure kicking toy of claim 10 wherein the second figure is comprised of a flexible material and a removable head, the figure further comprising a neck with a neck lip, the head comprising a neck receptacle with a neck lip, whereby pressure from the contacting foot of the first figure compresses air within the second figure, thereby causing the head to pop off of the second figure.

* * * * *